US010077649B2

(12) United States Patent
LeBlanc et al.

(10) Patent No.: US 10,077,649 B2
(45) Date of Patent: Sep. 18, 2018

(54) OPTICAL FIBER FEEDTHROUGH INCORPORATING FIBER BRAGG GRATING

(71) Applicant: Halliburton Energy Services, Inc., Houston, TX (US)

(72) Inventors: Michel LeBlanc, Houston, TX (US); Etienne Samson, Cypress, TX (US); William N. Gibler, The Woodlands, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 305 days.

(21) Appl. No.: 15/021,719

(22) PCT Filed: Aug. 9, 2013

(86) PCT No.: PCT/US2013/054382
§ 371 (c)(1),
(2) Date: Mar. 14, 2016

(87) PCT Pub. No.: WO2015/020674
PCT Pub. Date: Feb. 12, 2015

(65) Prior Publication Data
US 2016/0222777 A1 Aug. 4, 2016

(51) Int. Cl.
*E21B 47/06* (2012.01)

(52) U.S. Cl.
CPC ..... *E21B 47/06* (2013.01); *E21B 47/065* (2013.01)

(58) Field of Classification Search
None
See application file for complete search history.

(56) References Cited

U.S. PATENT DOCUMENTS 5,401,956 A 3/1995 Dunphy et al.
5,877,426 A * 3/1999 Hay ..... G01L 19/0092 250/227.14

(Continued)

FOREIGN PATENT DOCUMENTS

EP 0954743 B1 4/2004

OTHER PUBLICATIONS

International Search Report and Written Opinion issued in related PCT Application No. PCT/US2013/054382 dated May 23, 2014, 11 pages.

(Continued)

*Primary Examiner* — Robert R Raevis
(74) *Attorney, Agent, or Firm* — John Wustenberg; Baker Botts L.L.P.

(57) ABSTRACT

Methods and systems for effectively sealing a fiber optic line to a pressure gauge device are disclosed. A pressure gauge device has an outer body, a reference volume within the outer body and a pressure sensor having a first side and a second side. The first side of the pressure sensor is exposed to a pressure inlet and the second side of the pressure sensor is exposed to the reference volume. A fiber optic line is coupled to the pressure gauge device using a feedthrough device. The fiber optic line comprises a first fiber optic line portion located within the feedthrough device, a second fiber optic line portion located within the reference volume and a third fiber optic line portion located within a cable located outside the pressure gauge device and coupled to the feed through device. The first fiber optic line portion comprises a first Fiber Bragg Grating ("FBG").

20 Claims, 6 Drawing Sheets

(56) References Cited

U.S. PATENT DOCUMENTS

| | | | | |
|---|---|---|---|---|
| 6,016,702 | A * | 1/2000 | Maron | G01L 9/0039 250/227.14 |
| 6,422,084 | B1 | 7/2002 | Fernald et al. | |
| 2002/0041722 | A1 | 4/2002 | Johnson et al. | |
| 2005/0111793 | A1 | 5/2005 | Grattan et al. | |
| 2010/0219334 | A1 | 9/2010 | Legrand et al. | |
| 2011/0229071 | A1 * | 9/2011 | Vincelette | E21B 43/2406 385/13 |

OTHER PUBLICATIONS

International Preliminary Report on Patentability issued in related PCT Application No. PCT/US2013/054382 dated Feb. 9, 2016, 8 pages.

LeBlanc, M. et al., "Distributed strain measurement based on a fiber Bragg grating and its reflection spectrum analysis", in Optics Letters, vol. 21, No. 17 (1996), pp. 1405-1407.

LeBlanc, M. et al., "Fiber optic Bragg intra-grating strain gradient sensing", SPIE vol. 2444 (1995), pp. 136-147.

Office Action issued in related CA Application No. 2,916,266, dated Aug. 23, 2017 (6 pages).

* cited by examiner

OPTICAL FIBER FEEDTHROUGH INCORPORATING FIBER BRAGG GRATING

CROSS-REFERENCE TO RELATED APPLICATION

The present application is a U.S. National Stage Application of International Application No. PCT/US2013/054382 filed Aug. 9, 2013, which is incorporated herein by reference in its entirety for all purposes.

BACKGROUND

Hydrocarbons, such as oil and gas, are commonly obtained from subterranean formations that may be located onshore or offshore. The development of subterranean operations and the processes involved in removing hydrocarbons from a subterranean formation are complex. Typically, subterranean operations involve a number of different steps such as, for example, drilling a wellbore at a desired well site, treating the wellbore to optimize production of hydrocarbons, and performing the necessary steps to produce and process the hydrocarbons from the subterranean formation. Different stages of a subterranean drilling and completion operation often involve data collection and transmission of data signals between different locations in the system.

For instance, in certain applications, it may be desirable to determine pressure at a location downhole. In certain implementations, a fiber optic-based pressure gauge device may be used to collect pressure data and relay that information to a desired location in the system. Operation of a pressure gauge device is often dependent upon downhole temperatures. Therefore, in order to obtain accurate pressure data, it may be necessary to also monitor changes in downhole temperature. Because temperature is a parameter of interest in its own right, the necessity for a second sensor to monitor temperature is not deemed an impediment and the gauges used are typically marketed as pressure/temperature point measurement gauges.

In certain applications, a pressure/temperature point measurement gauge (referred to herein as a "fiber gauge") may include a pressure sensor and a temperature sensor. The temperature sensor of the fiber gauge may consist of a Fiber Bragg Grating ("FBG") which can be placed in line with the pressure sensor. With this arrangement, a single fiber may be used to interrogate both the pressure sensor and the temperature sensor.

In certain implementations, the free response of the FBG may be obtained by attaching each side of the fiber to a support assembly having a clamp (or other suitable means), with the FBG section suspended. In order to avoid tension in the FBG, the fiber length between the clamps may be longer than the distance between the clamps, providing a certain degree of slack. The slack is provided to ensure that a change in temperature does not result in development of a tension in the FBG section of the fiber due to differential thermal expansion of the fiber and the support assembly. In certain implementations, the support assembly may be made of a metal having a coefficient of thermal expansion which is larger than that of the fiber which may be made of silica.

An alternate approach to measure temperature using an FBG is to couple the FBG to a metallic structure so that the FBG's response to a change in temperature includes the effect of the thermal response of the host material to which it is coupled. This implementation facilitates a higher sensitivity to changes in temperature due to the (typically) larger Coefficient of Thermal Expansion ("CTE") of metals compared to silica. When using this approach, it is desirable to avoid elastic strain in the fiber host by decoupling the fiber host from outside forces to the highest degree possible.

In both the "free" and the "attached" implementations discussed above, space is needed in the assembly to accommodate the FBG and its supports. It is desirable to minimize this space in order to reduce the overall size of a pressure gauge incorporating such a device. Moreover, it is desirable that the FBG be exposed to the same temperature as the pressure sensor. Therefore, it is desirable for the FBG to be proximate to the pressure sensor and that thermal resistance between the FBG and the pressure sensor be minimized.

BRIEF DESCRIPTION OF THE DRAWINGS

These drawings illustrate certain aspects of some of the embodiments of the present invention, and should not be used to limit or define the invention.

FIG. 5(*b*) depicts the elastic strain profile along the FBG of FIG. 5(*a*).

FIG. 5(*c*) depicts the reflection spectrum of the FBG of FIG. 5(*a*).

FIG. 6(*b*) depicts the elastic strain profile along the FBG of FIG. 6(*a*).

FIG. 6(*c*) depicts the reflection spectrum of the FBG of FIG. 6(*a*).

Figure 1:
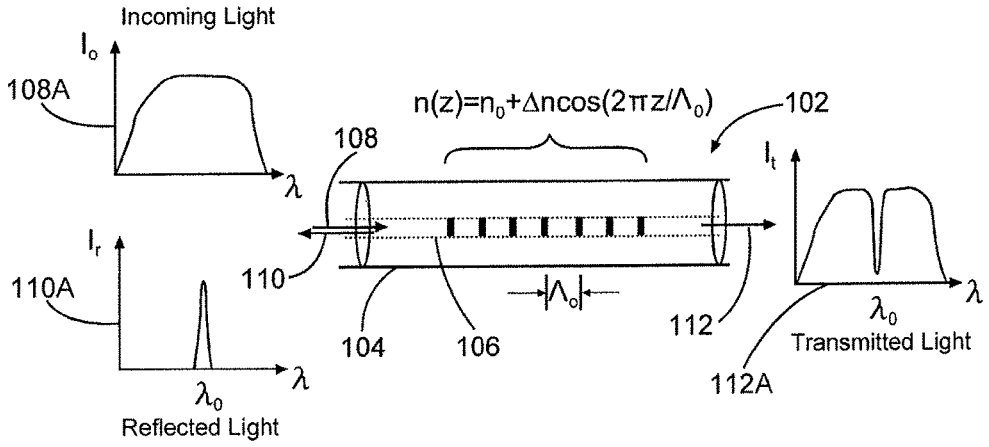
FIG. 1 shows a schematic representation of an FBG having a uniform refractive index modulation period of $\Lambda 0$.

While embodiments of this disclosure have been depicted and described and are defined by reference to example embodiments, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present invention relates to an improved pressure gauge device, and more particularly, to methods and systems for effectively sealing a fiber optic line to a pressure gauge device.

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory ("RAM"), one or more processing resources such as a central processing unit ("CPU") or hardware or software control logic, ROM, and/or other types of nonvolatile memory. Additional components of the information handling system may include one or more disk drives, one or more network ports for communication with external devices as well as various input and output ("I/O") devices, such as a keyboard, a mouse, and a video display. The information handling system may also include one or more buses operable to transmit communications between the various hardware components.

For the purposes of this disclosure, computer-readable media may include any instrumentality or aggregation of instrumentalities that may retain data and/or instructions for a period of time. Computer-readable media may include, for example, without limitation, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory ("EEPROM"), and/or flash memory; as well as communications media such as wires, optical fibers, microwaves, radio waves, and other electromagnetic and/or optical carriers; and/or any combination of the foregoing.

Illustrative embodiments of the present invention are described in detail herein. In the interest of clarity, not all features of an actual implementation may be described in this specification. It will of course be appreciated that in the development of any such actual embodiment, numerous implementation-specific decisions may be made to achieve the specific implementation goals, which may vary from one implementation to another. Moreover, it will be appreciated that such a development effort might be complex and time-consuming, but would nevertheless be a routine undertaking for those of ordinary skill in the art having the benefit of the present disclosure.

To facilitate a better understanding of the present invention, the following examples of certain embodiments are given. In no way should the following examples be read to limit, or define, the scope of the invention. Embodiments of the present disclosure may be applicable to horizontal, vertical, deviated, or otherwise nonlinear wellbores in any type of subterranean formation. Embodiments may be applicable to injection wells as well as production wells, including hydrocarbon wells. Embodiments may be implemented using a tool that is made suitable for testing, retrieval and sampling along sections of the formation. Embodiments may be implemented with tools that, for example, may be conveyed through a flow passage in a tubular string or using a wireline, slickline, coiled tubing, downhole robot or the like. Devices and methods in accordance with certain embodiments may be used in one or more of wireline, measurement-while-drilling ("MWD") and logging-while-drilling ("LWD") operations. "Measurement-while-drilling" is the term generally used for measuring conditions downhole concerning the movement and location of the drilling assembly while the drilling continues. "Logging-while-drilling" is the term generally used for similar techniques that concentrate more on formation parameter measurement.

The terms "couple" or "couples," as used herein are intended to mean either an indirect or a direct connection. Thus, if a first device couples to a second device, that connection may be through a direct connection, or through an indirect electrical, optical, or mechanical connection via other devices and connections. The term "uphole" as used herein means along the drillstring or the hole from the distal end towards the surface, and "downhole" as used herein means along the drillstring or the hole from the surface towards the distal end.

It will be understood that the methods and systems disclosed herein are not limited to applications relating to operations performed in an oil well. The present disclosure also encompasses applications relating to development of natural gas wells or hydrocarbon wells in general. Further, such wells can be used for production, monitoring, or injection in relation to the recovery of hydrocarbons or other materials from the subsurface.

When performing subterranean operations, it is desirable to be able to obtain remote measurements of pressure and temperature from a downhole location. A pressure gauge device in accordance with the present disclosure provides better temperature sensitivity than prior art pressure gauge devices operating under similar principles. The present disclosure provides a method and system which holds an FBG in place in the pressure gauge device such that the sensitivity of the FBG device is enhanced while the FBG is maintained proximate to the pressure sensor and is thermally coupled thereto. Furthermore, the methods and systems disclosed herein may be used to provide different diagnostics relating to the integrity of the seal at the feedthrough device or the tensile stress on the fiber optic line on one, or both sides of the feedthrough device. Therefore, the present inventions results in an improved sensitivity to temperature and provides means for remote diagnostic of the condition of the gauge such that certain types of failures can be detected from the surface using interrogation means to be described below.

Specifically, as discussed in more detail below, the pressure gauge device may be coupled to a fiber optic line that extends into the pressure gauge device and couples to a pressure sensor located therein. The fiber optic line may include a first portion that passes through a feedthrough device and into the pressure gauge device, a second portion that extends from the feedthrough device into a reference volume of the pressure gauge device and couples to the pressure sensor and a third portion that is directed to the feedthrough device through a cable. The feedthrough device permits the optical fiber line to traverse the boundary between the lead-in cable (having an indeterminate pressure) and the pressure gauge cavity or reference volume (having a reference pressure set at vacuum pressure or a reference gas pressure). Each of the first portion (feedthrough), second portion (reference volume) and third portion (cable) of the fiber optic line may include a corresponding first FBG, second FBG and third FBG. Further as discussed in more detail below, in certain implementations, the feedthrough device may include a single FBG that extends into the second portion and/or the third portion of the fiber optic line without departing from the scope of the present disclosure.

The methods and systems disclosed herein enable the performance of remote diagnostics to monitor the condition of the pressure gauge device downhole. For instance, using the methods and systems disclosed herein, one can remotely assess the reliability of the feedthrough device which as discussed in further detail below, functions as a seal that directs the fiber optic line into the pressure gauge device. Specifically, a failure in the bond between the first FBG and the first portion of the fiber optic line is indicative of a failure in the seal provided by the feedthrough device. Further, it may be desirable to avoid tension in the fiber optic line. Using the methods and systems disclosed herein, one can assess the tension in the second portion and third portions of the fiber optic line (the portions outside of the fiber feedthrough section) to ensure that this tension does not exceed a certain threshold value. Specifically, temperature at the particular downhole location may be determined using the first FBG, which is located in the feedthrough device. As discussed in further detail below, once temperature is known, any changes in the Bragg wavelength of the second FBG in excess of that caused by the temperature change can be attributed to changes in tension in the second portion of the fiber optic line. Similarly, once the downhole temperature is determined using the first FBG, any changes in the Bragg wavelength of the third FBG in excess of that caused by the temperature change may be attributed to changes in tension in the third portion of the fiber optic line. Accordingly, the methods and systems disclosed herein may be used to remotely monitor tension in the second portion and/or third portion of the fiber optic line. The structure and details of operation of a pressure gauge device in accordance with the present disclosure will now be discussed in further detail.

A Fiber Bragg Grating (FBG) is typically a short section of optical fiber that is exposed to laser radiation such that the index of refraction of the fiber core (or surrounding cladding) obtains a periodic modulation (of period $\Lambda$ and amplitude $\Lambda_n$) that results in the resonant coupling of light over a specific (and usually narrow) wavelength band. For instance, in certain implementations, an FBG may be between approximately 3 mm to approximately 10 mm long.

The variation of index is produced by the side-exposure of the optical fiber to UV laser light. During exposure, the UV beam contains interference fringes, produced by the optical arrangement, so that regions of high intensity UV light are separated by regions of no (or almost no) UV light intensity. The UV light produces a permanent change in the index of refraction of the fiber core in rough proportion to the intensity. The produced structure acts as a wavelength-selective mirror that reflects light back towards its source in the spectral region close to the Bragg wavelength, which is obtained as:

$$\lambda_B = 2n\Lambda \quad \text{[Eq. 1]}$$

As is well known in the art, an FBG can be used as a sensor because any change in n or $\Lambda$ will result in a change in the Bragg wavelength ($\lambda_B$). Particularly convenient is the fact that, if we assume initial values of $n_0$ and $\Lambda_0$, a change in $\lambda_B$ is given by:

$$\frac{\Delta\lambda_B}{\lambda_B} = \frac{\Delta(n\Lambda)}{n_0\Lambda_0} = \varepsilon_{opt} \quad \text{[Eq. 2]}$$

where $\varepsilon_{opt}$, is referred to as the "optical strain," and is the relative change in optical path length $n\Lambda$. For an FBG with n and $\Lambda$ that are uniform over its entire length, the reflectivity is highest at the Bragg wavelength and this peak reflectivity is given by:

$$R_{max} = R(\lambda_b) = \tanh\left(\frac{\eta\Delta n}{2n\Lambda}L\right) \quad \text{[Eq. 3]}$$

where $\eta$ is a parameter that expresses the effective overlap between the cross-section of the fiber that is affected by the index change and the mode of propagation for the light. Typically, only the fiber core will have a modulated index but the light extends outside the core for the extent of the evanescent wave. Therefore, we typically have $0.6<\eta<0.8$. Accordingly, the full-width, half-maximum bandwidth of the reflection peak is given by:

$$\Delta\lambda_{FWHM} = 2\lambda_B\sqrt{\left(\frac{\Lambda}{L}\right)^2 + \left(\frac{\eta\Delta n}{n}\right)^2} \quad \text{[Eq. 4]}$$

Because both $\Lambda$ and n are sensitive to strain and temperature, the FBG's reflection spectrum is also sensitive to changes in strain and temperature. The elastic strain $\varepsilon'_z$ is related to the total strain $\varepsilon_z$ as:

$$\varepsilon'_z = \varepsilon_z - \alpha_f\Delta T \quad \text{[Eq. 5]}$$

This relationship becomes useful when we consider that, from elasticity we have:

$$\varepsilon_z^f - \alpha_f\Delta T = \frac{\sigma_z^f}{E_f} - \frac{\nu_f\sigma_x^f}{E_f} - \frac{\nu_f\sigma_y^f}{E_f} \quad \text{[Eq. 6]}$$

Accordingly, if there is no transverse stress on the fiber, or if any traverse stress on the fiber is negligible, we have:

$$\varepsilon'_z = \varepsilon_z^f - \alpha_f\Delta T = \frac{\sigma_z^f}{E_f} \quad \text{[Eq. 7]}$$

Therefore, under pure axial stress condition, and with a temperature change from the original condition ($\Delta T - T_0$):

$$\frac{\Delta\lambda}{\lambda_B} = \varepsilon_{opt} = \left(1 + \frac{1}{n_0}\frac{\partial n}{\partial \varepsilon'_z}\right)\varepsilon_z + \left(\alpha_f + \frac{1}{n_0}\frac{\partial n}{\partial T}\right)\Delta T \quad \text{[Eq. 8]}$$

where:

$$\left(1 + \frac{1}{n_0}\frac{\partial n}{\partial \varepsilon'_z}\right) = K_{s'} = 1 - \frac{n_0^2}{2}[P_{12}(1-\nu_f) - P_{11}\nu_f] \approx 0.80 \quad \text{[Eq. 9]}$$

where $P_{11}$ and $P_{12}$ are the photo-elastic constants for the material. For instance, in certain illustrative embodiments:

$P_{11}$=0.113 (typ. for silica)

$P_{12}$=0.252 (typ. for silica)

$n_0$=1.4682 (typ. for fiber @ 1550 nm)

We also have:

$$\left(\alpha_f + \frac{1}{n_0}\frac{\partial n}{\partial T}\right) = K_T = 8.36\ \mu\varepsilon/^\circ\ \text{C.} \quad \text{[Eq. 10]}$$

The temperature sensitivity factor ($K_T$) applies to the case of an FBG not subjected to any stress. More typically, the FBG will have a coating and this coating will have a CTE that is different from that of silica. Therefore the coating will impart some stress on the fiber. However, for thin coatings, or for soft coatings (e.g., acrylates), the stress produced by the coating can be neglected. This is not true, however, for the case of an FBG mounted on a host structure, such as a metal. In this case, it is more appropriate to assume the FBG will be forced to have a total strain equal to that of the structure. Assuming that the stresses in this host structure are negligible so that its total state of strain is only due to its free thermal expansion, $\varepsilon_z^{\kappa}=\alpha_{\kappa}\Delta T$, with an appropriate choice of $T_0$ the elastic strain in the FBG may be expressed as:

$$\varepsilon_2' = (\alpha_h - \alpha_f)\Delta T \quad \text{[Eq. 11]}$$

To achieve this relationship, the value of $T_0$ must be selected as the value of temperature that makes $\varepsilon'_z=0°$. With such a choice, we then have:

$$\varepsilon_{opt} = \left(a_h + \frac{1}{n_0 \partial \varepsilon_z'}(\alpha_h - \alpha_f) + \frac{1}{n_0}\frac{\partial n}{\partial T}\right)\Delta T \quad \text{[Eq. 12]}$$

For example, for Inconel 718

$$\left(\alpha_h = \frac{14.0\ \mu\varepsilon}{C^0}C\right),$$

the temperature sensitivity numerically evaluates to:

$$\frac{\partial \varepsilon_{opt}}{\partial T} = \frac{\partial \varepsilon_{opt}}{\partial(\Delta T)} = \left(\alpha_h + \frac{1}{n_0}\frac{\partial n}{\partial \varepsilon_z'}(\alpha_h - \alpha_f) + \frac{1}{n_0}\frac{\partial n}{\partial T}\right) = \frac{19.1\ \mu\varepsilon}{C^\circ}C \quad \text{[Eq. 13]}$$

In other words, an FBG bonded to an Inconel 718 element that is itself free to expand/contract with temperature will have sensitivity to temperature that is 2.3 times greater than that of a free FBG.

As discussed below, in certain implementations, an FBG may be used in a feedthrough device. Most bonding methods that can be used to create a bond between the FBG and the feedthrough device will involve processing at an elevated temperature. For example, an epoxy such as Epoxylite 813 will require a cure at a particular temperature defined herein as ($T_{cure}$), with a typical value of ($T_{cure}$)=177° C. Alternatively, bonding using eutectic gold-tin solder will solidify at $T=T_{solidus}$ with $T_{solidus}$=280° C. In both these examples, we can consider the indicated process temperature to be the temperature of zero stress in the fiber, therefore $T_0=T_{cure}$, or $T_0=T_{solidus}$, as applicable. The operation temperature of the device will then be constrained to values of temperature below the process temperatures. We can therefore conclude that the part of the fiber attached to the feedthrough device will always be in a state of axial compression during operation, as discussed in conjunction with FIGS. 2A-2D below.

Turning now to FIG. 1, a schematic representation of an FBG having a uniform refractive index modulation period of ($\Lambda_0$) is depicted. As shown in FIG. 1, the FBG 102 may consist of an optical fiber 104 having a fiber core 106. An incoming light 108 may be transmitted into the fiber core 106. Part of the light 108 may be reflected back from the fiber core 106 (as indicated by arrow 110) while the remaining portions of the light 108 may be transmitted through the fiber core 106 (as indicated by arrow 112). In FIG. 1, the chart 108A indicates the light intensity ($I_0$) across different wavelengths ($\lambda$) for the incoming light 108. Similarly, the charts 110A and 112A depict the intensity of the reflected light 110 ($I_r$) and the transmitted light 112 ($I_t$) across different wavelengths ($\lambda$), respectively. Typically, the desired coupling is in the fundamental mode that is simply travelling in the opposite direction as the launched signal, so that the FBG 102 acts as a narrowband reflector. The wavelength of resonance where this coupling (to the back reflected mode) takes place is given by:

$$\lambda_0=2n_0\Lambda_0 \quad \text{[Eq. 14]}$$

where $\lambda_0$ is the peak reflected wavelength; $n_0$ is the effective refractive index of the grating in the fiber core 104; and $\Lambda_0$ is the grating period.

FIG. 1 depicts the effect of the reflection and transmission characteristics on a broadband incoming light spectrum. The index of refraction "n" along the length of the grating "z" of the fiber core 106 may be written as:

$$n(z)=n_0(z)+\Delta n(z)\cos(2\pi z/\Lambda_0) \quad \text{[Eq. 15]}$$

Strain and temperature can affect the index of refraction $n_0$ and the period $\Lambda_0$. Because strain and temperature may be non-uniform along the grating z, the index of refraction $n_0$ and the period $\Lambda_0$ may also vary along the grating z.

Accordingly, FBGs are sensitive to changes in both strain and temperature. Specifically, the wavelength shift of an FBG segment may be determined as:

$$\frac{\Delta\lambda}{\lambda_0} = \left[1 + \frac{E_f}{n}\frac{\partial n}{\partial \sigma}\right]\varepsilon_z' + \left[\alpha_f + \frac{1}{n}\frac{\partial n}{\partial \sigma_z}\right]\Delta T \quad \text{[Eq. 16]}$$

where $\lambda_0$ is the initial wavelength of the FBG segment; $E_f$ is the elastic modulus (Young's modulus) of the optical fiber material, n is the index of refraction, $\varepsilon'_Z$ is the elastic strain which is defined as total strain ($\varepsilon_{tot}$) minus the fiber thermal expansion ($\alpha_f\Delta T$); $\alpha_f$ is the coefficient of thermal expansion of the optical fiber material; and $\Delta T$ is the change in temperature.

Therefore, the wavelength shift of the FBG segment depends on both the elastic strain applied thereto and the temperature. In order for the measurement of the Bragg wavelength at the surface to be indicative of the temperature of the FBG only, the strain applied to the FBG must be taken into consideration. In certain implementations, the FBG section of the optical fiber may be suspended so that it does not touch any surface and the fiber is not in tension. This is the "free" response of the FBG, where the elastic strain is zero ($\varepsilon'_z=0$). In a typical FBG, the free response may be obtained as:

$$\frac{\partial\left[\frac{\Delta\lambda}{\lambda_0}\right]}{\partial T} = \left[\alpha_f + \frac{1}{n}\frac{\partial n}{\partial \sigma}\right] = 8.5\times10^{-6}/°\ \text{C.} = 8.5\ \mu\varepsilon/°\ \text{C.} \quad \text{[Eq. 17]}$$

If strain or temperature is not uniform along the Bragg grating, the different segments contribute reflectivity to different wavelengths according to Eq. 1, where now n=n(z) and $\Lambda=\Lambda(z)$. The peak reflectivity will not be as high as for a uniform grating of the same length. This can be understood from Eq. 3 since now the effective length of the grating contributing to each particular reflection wavelength is shorter than the full length of the grating L. In fact, the correspondence between strain profile and the reflection spectrum is such that it is possible to recover the strain profile along the Bragg grating from the reflection spectrum. For instance, more detail can be found in M. LeBlanc, S. Huang and R. M. Measures, "FIBER OPTIC BRAGG INTRA-GRATING STRAIN GRADIENT SENSING," Smart Structures and Materials 1995—SMART MATERI- ALS, SENSING, PROCESSING, AND INSTRUMENTATION, W. D. Spillman, Ed., Proc. SPIE Vol. 2444, pp. 136-147, SPIE, Bellingham, Wash. (1995), which is incorporated herein by reference in its entirety.

Turning now to FIG. 2, a pressure gauge device in accordance with an illustrative embodiment of the present disclosure is denoted generally with reference numeral 200. The pressure gauge device 200 may include a pressure sensor 202. In certain implementations, the pressure sensor 202 may be a pressure transducer which may include a sensing element consisting of one or more FBGs or one or more Fabry-Perot sensors, known in the art. The pressure transducer 202 is placed within an outer body 204. The outer body 204 includes a pressure inlet 206 to facilitate pressure readings by the pressure transducer 202. Specifically, one side of the pressure transducer 202 is exposed to the pressure from the pressure inlet 206 while the opposite side of the pressure transducer 202 is exposed to a reference pressure from a reference volume 207. The reference volume 207 may be at vacuum pressure or any other desired pressure that is to be used as the reference pressure. In order for the pressure gauge device 200 to be operable, it is desirable that the reference volume 207 contain the same amount of gas (in number of moles) as was present during the calibration process of the pressure transducer 202. Any leakage into or out of the reference volume 207 may cause a change in pressure, resulting in inaccurate readings by the pressure transducer 202.

A fiber optic line 208 may be coupled to the pressure transducer 202. The fiber optic line 208 may be disposed in a cable 210 and directed downhole through the cable 210 and into the pressure gauge device 200. In certain implementations, the fiber optic line 208 and the cable 210 may be configured as a fiber-in-metal tube. The fiber optic line 208 may pass through a feedthrough device 212 and into the reference volume 207 before it is coupled to the pressure transducer 202. The feedthrough device 212 isolates the reference volume 207 from outside pressure and leaks and substantially maintains a constant amount of gas (or lack thereof, in the case of a vacuum-referenced transducer) in the reference volume 207.

In certain embodiments, a first FBG 214, a second FBG 216, and a third FBG 218 may be disposed in the feedthrough device 212, the reference volume 207, and along the fiber optic line 208 in the cable 210, respectively. As discussed in more detail below, although three FBGs are depicted in the illustrative embodiment of FIGS. 2A-2D, the present disclosure is not limited to any specific number of FBGs. For instance, a single FBG could extend across the feedthrough device and perform the task now assigned to three FBGs.

In certain embodiments, the first FBG 214, the second FBG 216 and the third FBG 218 may be centered at different wavelengths so that the signals received from them can be separated at the surface (or another desirable location in the system) using wavelength-division multiplexing. The performance of wavelength-division multiplexing is well known to those of ordinary skill in the art and will therefore not be discussed in detail herein. Alternatively, a single grating may be long enough and positioned such that a portion of its length is within the feedthrough device and another portion falls within volume 207, or within the cable section 210, or both. In this implementation, the intra-grating sensing capability of the FBG may be utilized. This capability was already implied in our discussion of Eqs. 1 to 17 above and will not be discussed further as it is known to those of ordinary skill in the art.

In certain implementations, the first FBG 214 may be disposed within the feedthrough device 212. Specifically, the feedthrough device 212 may seal a first portion of the fiber optic line 208 (the portion located within the feedthrough device 212 as shown in FIG. 2) to the pressure gauge device 200. A section of the first portion of the fiber optic line 208 may form the first FBG 214. In certain implementations, the feedthrough device 212 may be a hermetic seal. The feedthrough device 212 protects the first FBG 214. Placement of the first FBG 214 inside the feedthrough device 212 mitigates the effect on the FBG 214 that may result from any tension on the fiber optic line 208 from the side proximate to the cable 210. Moreover, in most implementations (depending on the materials used), placement of the FBG 214 inside the feedthrough device 212 increases the sensitivity of the FBG 214 to changes in temperature. This is because silica has a very low CTE compared to most other materials such as metals. (This can be readily understood by considering the effect of having $\alpha h > \alpha j$ in Eq. 12.) With FBG 214 used to measure temperature, being decoupled from the effect of tension that might be present in the fiber sections in cable 210 or in reference volume 207, the reflection spectra of FBGs 216 and FBG 218 can now be used to determine the tension seen by those gratings and thus present in the portions of the fiber in the reference volume 207 and the cable 210, respectively, as shall now be further explained.

Figure 2A:
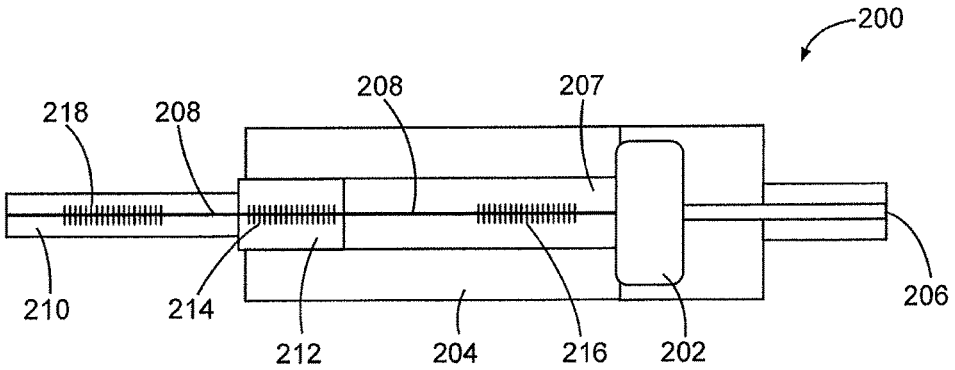
FIGS. 2A-2D show a pressure gauge device in accordance with an illustrative embodiment of the present disclosure.

In certain implementations, the first FBG 214 may be disposed within the feedthrough device 212 with a second FBG 216 disposed in the reference volume 207. Specifically, as shown in FIG. 2A, a second portion of the fiber optic line 208 may be disposed within the reference volume 207. A section of this second portion may be designed to form the second FBG 216. Readings from the first FBG 214 may be used in conjunction with readings from the second FBG 216 to determine whether any tension is present in the portion of the fiber optic line 208 that extends from the feedthrough device 212 to the pressure transducer 202. Tension in this portion of the fiber optic line 208 is undesirable and may lead to breaking of the fiber optic line 208. For instance, tension in the portion of the fiber optic line 208 extending between the feedthrough device 212 and the pressure transducer 202 may lead to detachment of the fiber optic line 208 from the pressure transducer 202. Accordingly, the ability to monitor tension in the portion of the fiber optic line 208 extending between the feedthrough device 212 and the pressure transducer 202 through the reference volume 207 is beneficial.

In operation, the first FBG 214 provides a response to temperature that is independent of tension in the fiber optic line 208 where the second FBG 216 is located. Accordingly, the first FBG 214 may be used to determine the existing temperature at a particular location downhole. Any shift from the Bragg grating wavelength of the second FBG 216 relative to the wavelength it should have at this measured temperature can then be interpreted as being due to tension in the portion of the fiber optic line 208 that extends in the reference volume 207.

In certain embodiments, the first FBG 214 may be used in conjunction with a third FBG 218 to monitor tension in a third portion of the fiber optic line 208 that is disposed within the cable 210. A section of the third portion of the fiber optic line 208 may be designed as the third FBG 218. Specifically, the first FBG 214 may be used to determine the existing temperature at a particular location downhole. Any shift from the Bragg grating wavelength of the third FBG 218 relative to the wavelength it should have at this measured temperature can then be interpreted as being due to tension in the portion of the fiber optic line 208 that is disposed in the cable 210.

In addition, in certain implementations, the first FBG 214, the second FBG 216 and the third FBG 218 may all be utilized to monitor tension in both, the section of the fiber optic line 208 that is disposed in the reference volume 207 and the section of the fiber optic line 208 that is disposed in the cable 210. Specifically, the actual temperature may be detected by the first FBG 214. Any shift from the Bragg grating wavelength of the second FBG 216 and the third FBG 218 relative to the wavelength they each should have at this measured temperature can then be interpreted as being due to tension in the corresponding portion of the fiber optic line 208.

In certain implementations, FBG 214 may be used to measure the strain profile over its length and assess the quality of strain transfer along the grating. Accordingly, in certain implementations, FBG 214 may be used to check the integrity of the seal surrounding the various portions of the fiber optic line 208 by an in situ method. An effective seal between the fiber optic line 208 and a host material requires a good bonding between the various interfaces. The term "host material" as used herein refers to the material in which the optical fiber may be disposed in the feedthrough device 212. In certain embodiments, the host material may be a metal. A good bond is able to transfer strain efficiently along a short axial length of the fiber optic line 208. Typically, the fiber optic line 208 may be coupled to the host material using a number of suitable methods known to those of ordinary skill in the art, such as, for example, using a soldering process, or with epoxy. Although the present disclosure is discussed in conjunction with using the soldering process, the same principles remain applicable when other methods of coupling the fiber optic line 208 to the host material are utilized. Once a successful soldering process is completed, the fiber optic line 208 may be strained in a state of axial compression. This compression may be larger in segments of the fiber optic line 208 that are disposed within the feedthrough device 212 compared to the portions that are disposed outside of the feedthrough device 212 where the only non-glass material acting on the fiber optic line 208 is the fiber coating itself, which, because it is thin, causes a much smaller stress on the fiber optic line 208.

Development of a state of radial tension between the fiber coating and the fiber optic line 208 or between the fiber coating and the host material, tending to separate the interfaces, may deteriorate the seal between the fiber optic line 208 and the host material. Simultaneously, with the loss of interfacial integrity, the host material may no longer be able to preserve the axial compression in the fiber optic line 208 and the strain profile along the portion of the fiber optic line 208 in the feedthrough device 212 may be considerably altered. This will cause a detectable shift in the reflection spectrum of the grating 214 thereby providing a means to detect such damage and deterioration of the feedthrough condition.

In accordance with certain embodiments of the present disclosure, the full reflection spectrum of the FBG 214 may be analyzed, by the intra-grating sensing approach already mentioned, to provide the strain profile along the fiber optic line 208 which may further increase the diagnostic capability provided by grating 214.

Figure 2B:
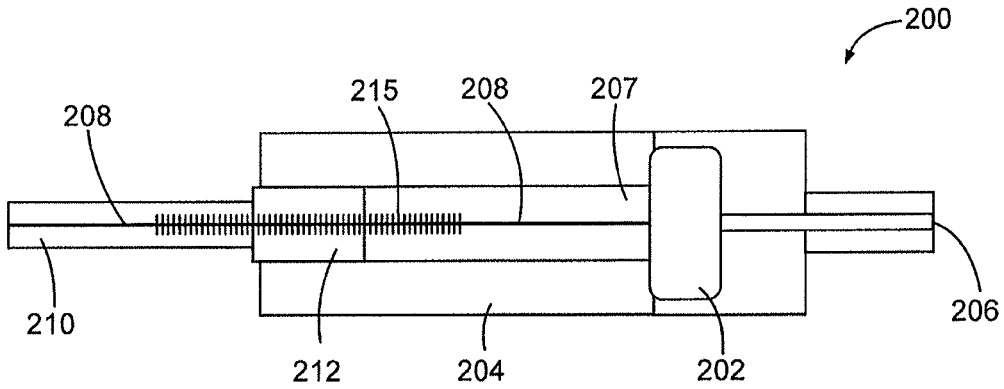
Figure 2C:
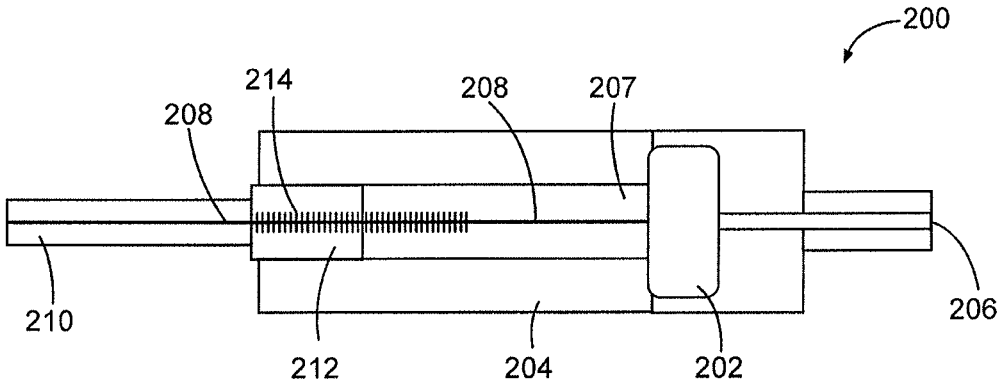
Figure 2D:
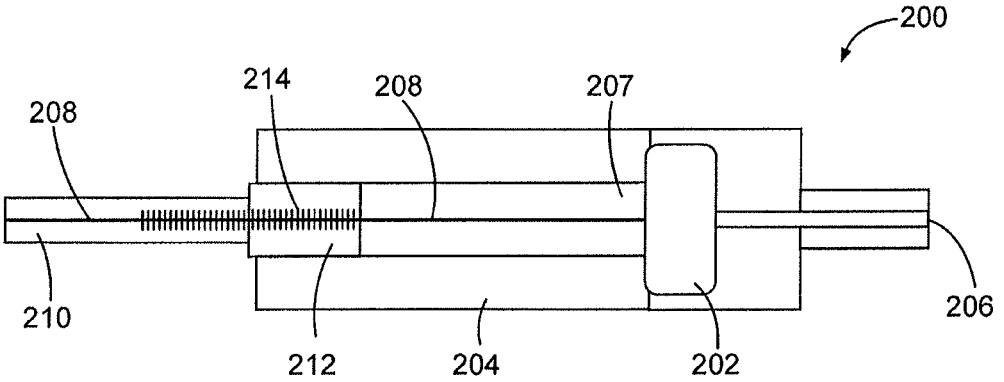

In certain implementations, as shown in FIG. 2B, the three FBGs 214, 216 and 218 may be disposed next to each other, forming sections of a single grating 215 that extends on one or both sides of the feedthrough device 212. The strain profile is indicative of the state of axial stress along the length of the fiber optic line 208. This strain profile may then be used to infer the state of the bond between the fiber optic line 208 and the host material or between the fiber optic line 208 and its coating. For instance, the strain profile obtained may permit detection of a loss of bond, such loss of bond being one of the possible causes of loss of a good seal. In other embodiments, as shown in FIGS. 2C and 2D, extension of FBG 214 into the reference volume 207 or extension of FBG 214 into the cable section 210 can achieve the same purpose of the combination FBG 214+FBG 216, or FBG 214+FBG 218, respectively, without departing from the scope of the present disclosure.

Figure 3:
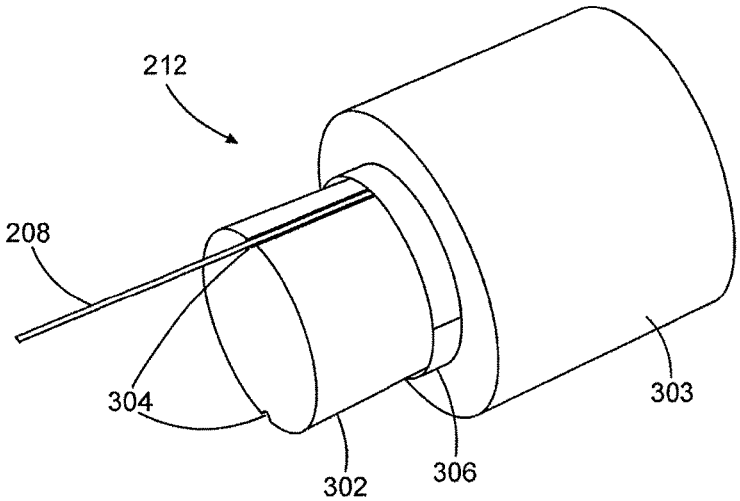
FIG. 3 depicts a feedthrough device in accordance with an illustrative embodiment of the present disclosure.

The fiber optic line 208 may be made of any suitable material, such as, for example, silica. In contrast, the outer body 204 is typically made of a high-strength corrosion resistant metal such as Inconel 718. Therefore, there is a notable mismatch of material properties between the different components that interface in the system. Specifically, the different components may have different values of coefficient of thermal expansion ("CTE"). Accordingly, development of a seal between the different components that remains effective over a wide range of temperatures can be challenging. FIG. 3 depicts a feedthrough device 212 in accordance with an illustrative embodiment of the present disclosure. As discussed in detail below, the feedthrough device 212 provides an effective seal between the fiber optic line 208 and a receptacle 303, thereby effectively coupling the fiber optic line 208 to the pressure gauge device 200.

As shown in FIG. 3, the feedthrough device 212 may include an insert 302 that can be inserted into a receptacle 303. Further, the feedthrough device 212 may have one or more slits 304. In certain implementations, the insert 302 may be a truncated cone. Specifically, the insert 302 may be a tapered cylinder with one end having a diameter that is smaller than that of the other end. In certain implementations, the insert 302 may be made from a metal and may be compatible with soldering and/or brazing. For instance, in one implementation, the insert 302 may be made from gold coated Kovar or other suitable metals having a controlled CTE. Due to its conical shape, the insert 302 may be mechanically blocked from sliding all the way through the receptacle 303. The slits 304 may be formed longitudinally along the outer, quasi-cylindrical surface of the insert 302. The slits 304 may have a number of different suitable cross-sectional shapes. For instance, in certain implementations, the slits 304 may have a rounded shape at the bottom thereof or may have sharp corners angled at approximately 90°. It may be desirable to use slits 304 having a rounded bottom in order to reduce the likelihood of having spots that are not filled with solder. Moreover, using round bottom slits 304 makes the assembly more closely match how it is modeled for the distribution of radial stress discussed further below.

The insert 302 may be coupled to the receptacle 303 using any suitable methods known to those of ordinary skill in the art. For instance, in certain implementations, the insert 302 may be coupled to the receptacle 303 using a solder film 306 applied by a soldering process. Accordingly, as discussed in more detail below, the solder film 306 may couple the insert 302, the receptacle 303 and the portion of the fiber optic line 208 that runs therethrough. The solder film 306 may be cut and shaped to match the shape of the insert 302. The solder film 306 may be made from any suitable material known to those of ordinary skill in the art having the benefit of the present disclosure. For instance, in certain implementations, the solder film 306 may be made from a eutectic gold-tin solder and may have a thickness of approximately 0.003". However, this particular composition and thickness of the solder film 306 are provided as an illustrative example only and are not intended to limit the scope of the present disclosure.

Further, in certain embodiments, a flux may be used to facilitate the soldering of the insert 302 into the receptacle 303. As would be appreciated by those of ordinary skill in the art, having the benefit of the present disclosure, a solder paste may be used in certain implementations instead of using solder and flux. The solder film 306 may be inserted in the receptacle 303 before placing the insert 302 therein. The fiber optic line 208 may have a metal coating making it compatible with soldering and/or brazing operations. The fiber optic line 208 may be coated with any suitable material, including, but not limited to gold or copper. The use of gold coated parts (e.g., the insert 302, the receptacle 303 or the fiber optic line 208) may increase the re-melting point of the joint by changing the composition of the alloyed solder. Specifically, during the soldering process, the gold from the coating may be taken up by the solder and the increased gold composition may result in a higher melting point, which is desirable to achieve a higher temperature rating for the seal created between the fiber optic line 208, the insert 302 and the receptacle 303.

Each fiber optic line 208 that is to be directed through the feedthrough device 212 may be placed in a slit 304 of the insert 302. There may be one or more slits 304 distributed along the outer perimeter of the insert 302. Each slit 304 may contain a single fiber optic line 208. Alternatively, one or more of the slits 304 may be deep enough to contain two or more fiber optic lines 208. In certain embodiments, the one or more slits 304 may be machined onto the insert 302. For instance, electrical discharge machining ("EDM") may be used to create the slits 304. In certain implementations, four slits 304 may be machined in the insert 302, each accommodating a fiber optic line 208, with two of the slits 304 machined at close angular positions to each other and two other slits machined diametrically opposite the first set and approximately 180° offset from the first set. The present disclosure is not limited to any specific depth, number or configuration of slits 304 on the insert 302 and the number, configuration or depth of the slits 304 may be varied without departing from the scope of the present disclosure.

Once the flux, solder film 306, insert 302, and fiber optic lines 208 are in position, a high temperature may be applied to the interface between the insert 302 and the receptacle 303, forming a solder joint between these components. A number of different methods may be used to apply the high temperature. For instance, in certain implementations, inductive heat coupling may be used to heat the interface between the insert 302 and the receptacle 303 to create the joint. In order to achieve an optimal bond between the different components, it is desirable to follow the solder manufacturer's recommended temperature against time profile. For instance, if eutectic gold/tin solder is used, it may be desirable to achieve a peak temperature of approximately 320° C. after the solder film 306 has been above 280° C. for no more than one minute.

It may be desirable to apply a force to the larger diameter end of the insert 302. This application of force may increase the contact pressure between the insert 302, the solder film 306 and the receptacle 303 and may promote the flow of the solder to all the mating surfaces, including around the coated fiber optic line 208.

The shape of the inner portion of the receptacle 303 may depend on the dimensions of the insert 302 and the thickness of the solder film 306. The outer dimensions of the receptacle 303 may vary depending on the structure to which the feedthrough device 212 needs to attach. For instance, the receptacle 303 may be shaped as a cylinder in order for the feedthrough device 212 to engage a cylindrical pressure gauge body. As depicted in more detail below, the feedthrough device 212 may be coupled to the outer body 204 using methods known to those of ordinary skill in the art. For instance, the feedthrough device 212 may be hermetically welded to the outer body 204. Moreover, the receptacle 303 need not be a part distinct from the structure to which it is attached. For instance, in certain implementations, the receptacle 303 may be an integral part that is machined on to the structure of interest (e.g., the outer body 204).

In designing the interface between the insert 302, the receptacle 303 and the fiber optic line 208, it is important to take into account the CTE of the various components (e.g., the insert 302, the solder film 306, and the feedthrough device 212) because of the various thermal stresses at play when the device is utilized downhole. Further, once the insert 302 is coupled to the receptacle 303 in the manner discussed above, it is important that the stresses on the fiber optic line 208 be minimal so that cracks are not formed in the fiber optic line 208 and the coating preserves its integrity. Typically, the CTE of the fiber optic line 208 is small (e.g., $0.5\times10-6$ m/m° C.) compared to the CTE of the metals used in the construction of the gauge's body, such as Inconel, with a CTE of $13.5\times10-6$ m/m° C. To minimize the stresses on the fiber and on the interfaces, the material for the insert 302 is chosen so that its CTE is lower than that of Inconel. For instance, in certain illustrative embodiments, the insert 302 may be made of Alloy 49 which has a low CTE (approximately $8.3\times10-6$ m/m° C.) and is compatible with other metals such as Inconel 718, via welding or other suitable means. In one illustrative embodiment, the optical fiber line 208 used may have an outer (glass) diameter of approximately $125\times10-6$ m and the gold coating thereon may have a thickness of approximately $15\times10-6$ m resulting in a fiber optic line 208 having a total outer diameter of approximately $155\times10-6$ m. This fiber optic line 208 may be fitted in a slit 304 that is approximately $250\times10-6$ m wide and $250\times10-6$ m deep. Although axial stress in the fiber optic line 208 may remain with this choice of material, the residual axial stress in the fiber optic line 208 is compressive and helps minimize the chance of a fracture.

The recited materials and dimensions are provided for illustrative purposes only. However, the present disclosure is not limited to any specific materials or dimensions for the different components. Accordingly, one or more of the recited materials and/or dimensions may be changed without departing from the scope of the present disclosure. When designing the interface between the insert 302 and the receptacle 303, it may be desirable to take into account the effects of both axial stress and radial stress on the components such as the fiber optic line 208. Specifically, in addition to minimizing axial stress as discussed above, it may be desirable to keep the radial stress at the fiber/coating interface and the coating/host material interface to be compressive to help preserve a good overall seal. At the same time, it may also be desirable to avoid plastically deforming the coating, which can occur when large stresses develop in view of the very large range of temperatures a pressure gauge intended for downhole use must be able to tolerate. In order to analyze the seal of fiber optic line 208-coating interface and the coating-host material interface in the portion of the fiber optic line 208 embedded in feedthrough device 212, a model of the fiber optic line 208 surrounded by a coating material is developed. In this model, the coating may be defined as including both the initial gold coating of the fiber and the layer of gold/tin solder surrounding it. One of the important parameters determined in this analysis is the effective transverse (i.e., radial) coefficient of thermal expansion of the structure, which is determined by considering the radial expansion of the outer coating surface of the fiber and the coating (in the expanded sense just defined) sub-structure. This effective transverse CTE may depend on the thickness of the gold and/or gold/tin coating layer, which practically depends on the width and depth of the slit 304 in the insert 302. If the effective CTE of the fiber optic line 208, coating and the solder film 306 is smaller than that of the host material (i.e., the insert 302), a state of radial compression will be present at all interfaces after the temperature is brought down following the soldering process.

Figure 3A:
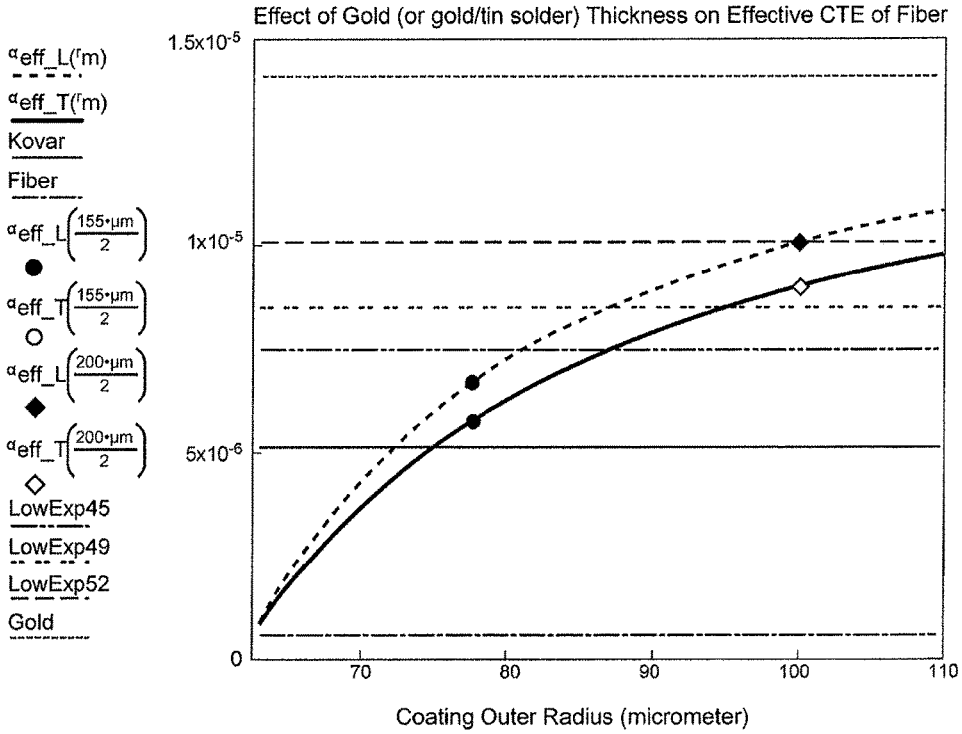
FIG. 3A depicts a graph reflecting the effect of coating thickness on the effective CTE of an optical fiber.

FIG. 3A depicts a graph reflecting the effect of coating thickness on the effective CTE of an optical fiber for different values of coating thickness (expressed in the figure by the outer radius of the coating rm). Specifically, FIG. 3A depicts a graph showing the effect of gold (or gold/tin solder) thickness on the effective CTE of a fiber optic line. In the illustrative embodiment of FIG. 3A, the fiber optic line 208 comprises silica having a diameter of 125×10−6 m surrounded by a coating of gold material. In this graph, the values on the x-axis indicate the coating outer radius in micrometers and the values on the y-axis depict a corresponding effective CTE value. The horizontal lines represent the CTE values of different materials which could be used as host for the fiber optic line and coating substructure, ranging from silica (labeled "Fiber") (the lowest value, with CTE=0.5×10−6 m/m° C.), to gold (CTE=14.0×10−6 m/m° C.). The CTE for Kovar, and other illustrative controlled-expansion, nickel-rich alloys listed as Alloy 45 ("LowExp45"), Alloy 49 ("LowExp49") and Alloy 52 ("LowExp52") are also represented. There are two curves which show the effective radial (lower curve noted as "αeff_T(rm)") and longitudinal (upper curve noted as "αeff_L(rm)") coefficient of thermal expansion. As shown in FIG. 3A, the black circle indicates the effective longitudinal CTE and the white circle indicates the effective radial CTE corresponding to a 155×10−6 m outer diameter gold-coated fiber. Similarly, the black diamond indicates the effective longitudinal CTE and the white diamond indicates the effective radial CTE corresponding to a 200×10−6 m outer diameter gold-coated fiber.

For example, if we look at the effective CTE data represented by the round points in FIG. 3A, corresponding to the 155×10−6 m outer diameter gold-coated fiber, we see that the effective radial CTE (noted with the white circle) of the fiber and coating sub-structure is higher than that of Kovar, which indicates that Kovar has a CTE that is too low to prevent a state of radial tension in the coating. Accordingly, in certain implementations, the insert 302 may be made of other materials that have a higher CTE than Kovar.

It will be readily understood that, on a first estimate that ignores the effect of axial stress, if the effective radial CTE of the fiber and coating assembly matches that of the host material, there will be no radial stress at the coating/host interface. In the case of a gold-coated fiber, with a thin eutectic gold/tin solder, such a matched CTE signifies that the radial stresses inside the coating and at the coating/fiber interface would be the same as if the fiber was not embedded. Such a condition is desirables since we expect the performance of such an embedded coating fiber assembly to be the same as if the fiber was not embedded.

For example, if a fiber-coating system is rated for a temperature range of −40° C. to +250° C., we would expect that this rating would be preserved if the fiber is embedded in a host material that matches its radial CTE.

This analysis can be further refined by taking the effect of axial tension into the embedded fiber and coating substructure composite due to the axial expansion of the host. We see from FIG. 3A that for a gold coated fiber (or fiber with a thick layer of gold-tin solder) the effective axial CTE of the coated fiber is larger than the effective radial CTE of the coated fiber. Since it is desirable to have axial compression after the soldering process, this means that the host material should be chosen so its CTE is higher than the effective axial CTE of the coated fiber. This will result in a state of compression in the optical fiber, which is desirable, and a state of radial compression, which is also desirable.

Figure 4:
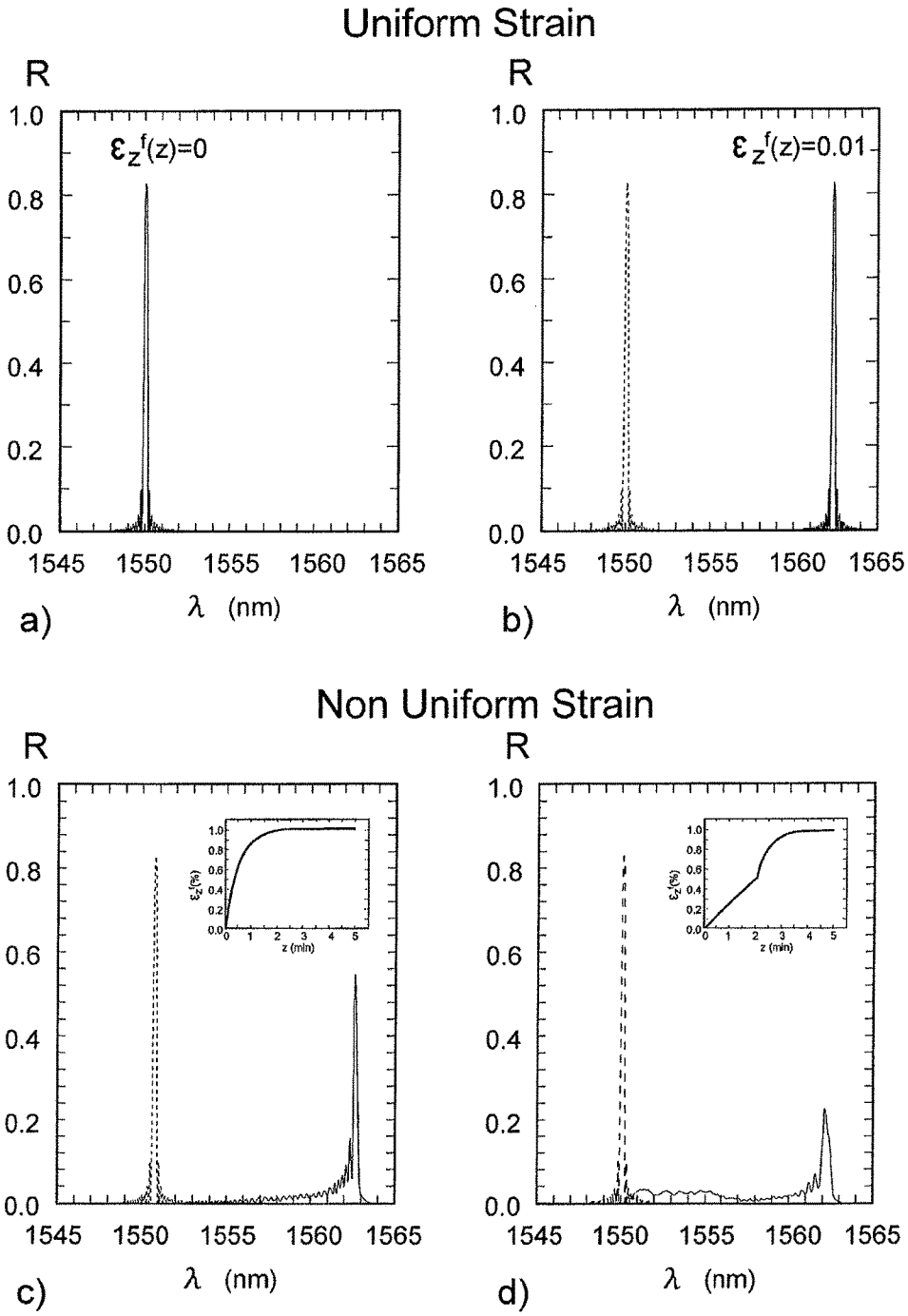
FIGS. 4(*a*)-4(*d*) depict reflection spectra of an FBG under different conditions.
Figure 5A:
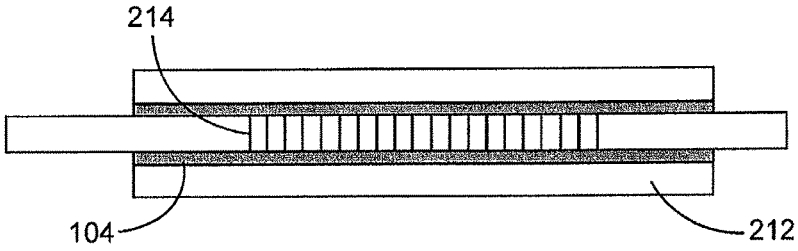
FIG. 5(*a*) depicts an FBG installed in a feedthrough device under normal conditions.
Figure 5B:
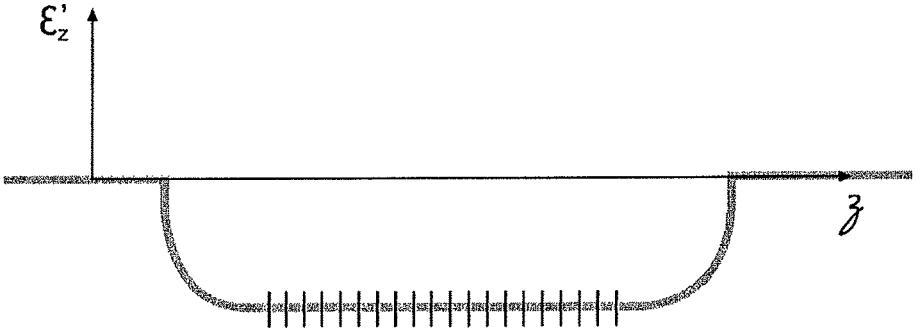
Figure 5C:
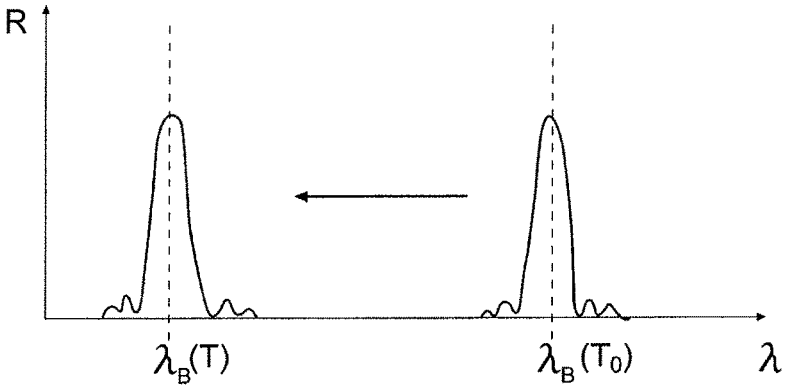

Turning now to the use of the intra-grating sensing for diagnostic purposes, FIGS. 4(*a*)-(*d*) will be used to illustrate the effect of now uniform strain on the reflection spectra of FBGs in a generic way and FIGS. 5(*a*)-(*c*) and 6(*a*)-(*c*) will be used to illustrate the effect of loss of adhesion on the reflection spectrum on a fiber Bragg grating 214 embedded in fiber feedthrough 212.

FIGS. 4(*a*)-(*d*) depict reflection spectra of an FBG under different conditions. Each of the charts (a)-(d) depicts a plot of the wavelength (λ) of the applied signal against reflectivity (R) under different strain conditions. Specifically, the chart 4(*a*) depicts the reflection spectrum for an unstrained condition; chart 4(*b*) depicts the reflection spectrum when a uniform tensile axial strain of 1% is applied; chart 4(*c*) depicts the reflection spectrum when a non-uniform axial strain is applied with the FBG positioned along a region of strain transfer having a good adhesion; and chart 4(*d*) depicts the reflection spectrum when a non-uniform strain is applied and debond and slippage (with remaining frictional stress transfer) has occurred along a portion of the FBG while good adhesion remains in the rest of the FBG. It is readily apparent that strain gradients along the FBG markedly change the reflection spectrum of the FBG. Each of the FIGS. 4(*a*)-(*d*) includes an inset that depicts the strain profile corresponding to the particular reflection spectrum. Specifically, a detailed strain profile may be extracted from the reflection spectrum using various processing techniques, as described in M. LeBlanc, S. Huang and R. M. Measures, "FIBER OPTIC BRAGG INTRA-GRATING STRAIN GRADIENT SENSIN, " Smart Structures and Materials 1995-SMART MATERIALS SENSING PROCESSING, AND INSTUMENTATION, W.D. Spillman, Ed., Proc. SPIE Vol. 2044, pp. 136-147, SPIE, Bellingham, Wash. (1995) .

That is also shown in FIG. 4. Specifically, straining the fiber changes the wavelength of the reflected signal (i.e., the λ value). If the strain is uniform, the fiber will be strained accordingly and will be longer at every point along its length as reflected in FIG. 4*b*. If the strain along the fiber is not uniform, every section of the grating contributes to its own wavelength. For example, in FIG. 4*c*, the strain is almost all at 1% and therefore, there is still a peak at 1562 nm. However, this peak is not as strong as the one in FIG. 4(*b*) because there is less grating there. All of the other wavelengths are also contributing to the overall strain and as a result, a higher intensity remains around these other wavelengths.

FIG. 4(*d*) represents a different reflection spectrum. The strain profile may be back-calculated from the reflection spectrum. As a result, one can obtain the profile (shown in the inset) by interpreting the reflection spectrum. Here, we used the profile (inset) to arrive at the bigger charts in FIGS.

4*c* and 4*d*. The paper M. LeBlanc, S. Huang and R. M. Measures, "FIBER OPTIC BRAGG INTRA-GRATING STRAIN GRADIENT SENSING," Smart Structures and Material 1995-SMART MATERIALS, SENSING, PROCESSING, AND INSTRUMENTATION, W. D. Spillman, Ed., Proc. SPIE Vol. 2444, pp. 136-147, SPIE, Bellingham, Wash. (1995). describes one method on how to go back to the strain profile from the reflection spectrum. From the strain profile, FIG. 4*c* shows a grating that is attached only at one end (e.g., a grating where the fiber is cut at the end of the grating) so at the end of the grating the strain is almost zero (because there is nothing pulling on it) and then further along the grating the strain becomes uniform. Consequently, the strain profile shown at the inset of FIG. 4*c* resembles that of a grating that ends right at the entrance of the feedthrough device 212. Accordingly, at the entrance of the feedthrough device 212 there is no strain.

The profile depicted in FIG. 4(*c*) differs from that of FIG. 4(*d*). Specifically, the profile depicted in FIG. 4(*d*) corresponds to a case where there is some slippage (e.g. gold coated fiber). Specifically, the straight line shown in the strain profile of FIG. 4(*d*) shows the friction in the coating/fiber which is not bonded anymore and will therefore go up. The strain profile can then be obtained from the reflection spectrum.

FIG. 5(*a*) depicts a close up view of the feedthrough device 212 with the FBG 214 located therein. FIG. 5(*b*) depicts the strain profile along FBG 214 located in the center of the feedthrough device 212. Specifically, FIG. 5(*b*) depicts a plot of the elastic strain along the length of the FBG 214, which is ideally compressive, as illustrated. FIG. 5(*c*) depicts the reflection spectrum of FBG 214, both at the cure (or soldering) temperature T0 and at the operation temperature T<T0. Under the normal condition of the bond at the feedthrough device 212 as shown in FIGS. 5(*a*)-(*c*), the strain profile along the FBG 214 is uniform and the resulting FBG reflection spectrum is narrow.

Figure 6A:
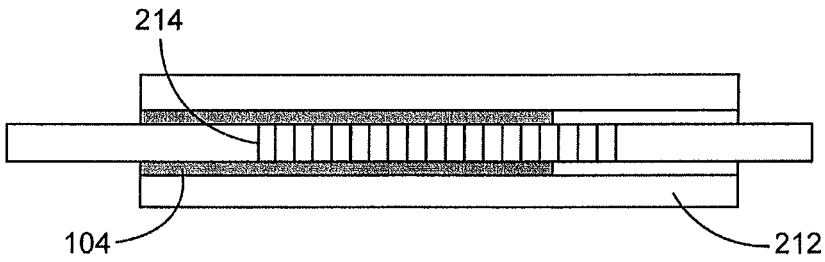
FIG. 6(*a*) depicts an FBG installed in a feedthrough device where there is a loss of bond between the fiber and the feedthrough device.
Figure 6B:
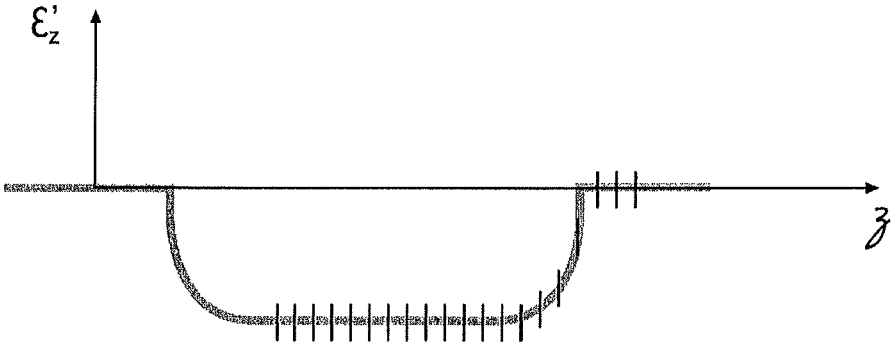
Figure 6C:
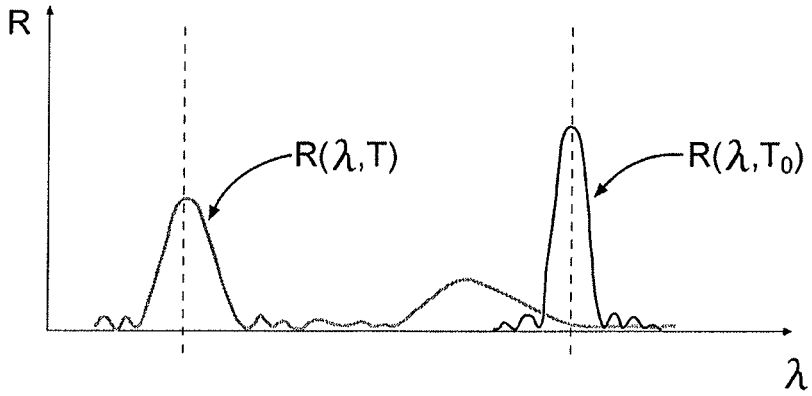

FIG. 6A depicts a cross sectional view of the FBG 214 at the feedthrough device 212 where there is a loss of bond between the fiber 104 and the feedthrough device 212. FIG. 6B depicts a plot of the elastic strain along the length of the FBG 214 under these conditions. In the illustrative embodiment of FIG. 6(*b*), the strain profile along the FBG 214 can no longer be considered uniform. FIG. 6(*c*) depicts the reflection spectrum from the FBG 214 when there is a loss of bond as shown in FIG. 6(*b*). As shown in FIG. 6(*c*), the loss of bond results in a distortion of the reflection spectrum R(λ, T) compared to its original shape at the zero stress temperature R(λ, T0). For instance, there are now two peaks and reflectivity of the main peak is reduced compared to the original peak. The peak at the lower wavelength is due to the bonded section of the grating but has lower maximum reflectivity compared to that of FIG. 5(*c*) because the total length of the grating contributing to that spectrum is shorter. The secondary peak is due to the debonded section of the grating. Its position is less displaced relative to the position of the peak with at T0 because there is no compressive elastic strain in the fiber in this section. Therefore, by monitoring the full spectrum of FBG 214, or at least its maximum reflectivity, one can monitor the feedthrough device 212 for the onset of damage at the FBG/feedthrough interface. In this manner, a disturbance to the strain profile seen by the FBG 214 will be detectable.

Returning now to FIG. 2, it may be expected that FBG 216 and FBG 218 give reflection spectra similar to those shown in FIGS. 4(*a*) and 4(*b*), with shifts ideally only due to temperature. The presence of a larger shift than expected in FBG 218, based on the temperature measurement of FBG 214, would indicate that the fiber optic line 208 in the cable 210 is under tension and a measurement of that tension can be calculated. In contrast, if FBG 214 occupies one side of the feedthrough device 212, it should have a response similar to that of FIG. 4(*c*) (except mirrored along the wavelength axis if compressive strain is present). If instead a spectrum such as FIG. 4(*d*) is obtained, (again, flipped along the wavelength axis if we are dealing with compressive strains), then we know that some slippage is occurring. As would be appreciated by those of ordinary skill in the art, having the benefit of the present disclosure, a variety of strain profiles are possible and their knowledge provides very useful diagnostic information about the state of the fiber optic line, the feedthrough device and the pressure gauge back chamber (i.e., reference pressure volume 207).

Furthermore, in accordance with certain embodiments, the first FBG 214 and the second FBG 216 may be used in conjunction with one another in a differential mode to obtain a measurement of temperature free from the effect of certain drift factors. When operating in the differential mode, the wavelength shifts of the two gratings (each normalized to the grating's original wavelength) are determined and used in order to substantially eliminate one or more common drift factors such as, for example, long term effects of temperature on both gratings, to the extent that the deleterious effect causes a similar normalized wavelength shift on both FBGs. When using the first FBG 214 and the second FBG 216 in the differential mode, it is assumed that no elastic strain is present on FBG 216. Let $K_{214}$ be the temperature sensitivity of FBG 214 and $K_{216}$ be the temperature sensitivity of FBG 216. Without any source of drift, the measured wavelengths will satisfy:

$$\varepsilon_{214}^{opt} = \frac{\lambda_{214}(T) - \lambda_{214}(T_0)}{\lambda_{214}(T_0)} = K_{214}(T - T_0) \quad \text{[Eq. 18]}$$

$$\varepsilon_{216}^{opt} = \frac{\lambda_{216}(T) - \lambda_{216}(T_0)}{\lambda_{216}(T_0)} = K_{216}(T - T_0) \quad \text{[Eq. 19]}$$

Let's now assume that a source of drift, such as thermal decay of the gratings, results in shifts $\varepsilon_{214_drift}^{opt}(t)$ and $\varepsilon_{216_drift}^{opt}(t)$, in both gratings. The response of each grating is thus written as:

$$\varepsilon_{214}^{opt} = \frac{\lambda_{214}(T) - \lambda_{214}(T_0)}{\lambda_{214}(T_0)} = K_{214}(T - T_0) + \varepsilon_{214_drift}^{opt}(t) \quad \text{[Eq. 20]}$$

$$\varepsilon_{216}^{opt} = \frac{\lambda_{216}(T) - \lambda_{216}(T_0)}{\lambda_{216}(T_0)} = K_{216}(T - T_0) + \varepsilon_{216_drift}^{opt}(t) \quad \text{[Eq. 21]}$$

If we subtract these two, we get:

$$\Delta\varepsilon^{opt}(T,t) = (\varepsilon_{214}^{opt} - \varepsilon_{216}^{opt}) = (K_{214} - K_{216})(T - T_0) + (\varepsilon_{214_{drift}}^{opt}(t) - \varepsilon_{216_{drift}}^{opt}(t)) \quad \text{[Eq. 22]}$$

Consequently, if for our analysis we use $\Delta\varepsilon^{opt}(T,t)$, and if $\varepsilon_{214_{drift}}^{opt}(t) = \varepsilon_{216_drift}^{opt}(t)$, we can use this output (which requires the processing of both gratings 214 and 216) to recover our temperature measurement T from the equation:

$$T = T_0 + \frac{\Delta\varepsilon^{opt}}{(K_{214} - K_{216})} \quad \text{[Eq. 23]}$$

In accordance with certain embodiments of the present disclosure, the FBGs 214, 216, 218 may be monitored using an information handling system (not shown). Further, in certain implementations, the information handling system may include machine readable instructions in computer-readable media to process the data from the FBGs 214, 216, 218. The information handling system may include a user interface permitting a user to operate and/or monitor the data collected. In certain illustrative embodiments, the information handling system may issue a notification if the tension in certain portions of the fiber optic line 208 exceeds a pre-set threshold value.

The present invention is therefore well-adapted to carry out the objects and attain the ends mentioned, as well as those that are inherent therein. While the invention has been depicted, described and is defined by references to examples of the invention, such a reference does not imply a limitation on the invention, and no such limitation is to be inferred. The invention is capable of considerable modification, alteration and equivalents in form and function, as will occur to those ordinarily skilled in the art having the benefit of this disclosure. The depicted and described examples are not exhaustive of the invention. Consequently, the invention is intended to be limited only by the spirit and scope of the appended claims, giving full cognizance to equivalents in all respects.

What is claimed is:

1. A system for monitoring pressure in a subterranean formation comprising:

a pressure gauge device having an outer body, a reference volume within the outer body and a pressure sensor having a first side and a second side, wherein the first side of the pressure sensor is exposed to a pressure inlet and the second side of the pressure sensor is exposed to the reference volume;

a feedthrough device; and a fiber optic line coupled to the pressure gauge device, wherein the fiber optic line comprises a first fiber optic line portion located within the feedthrough device, a second fiber optic line portion located within the reference volume and a third fiber optic line portion located within a cable located outside the pressure gauge device and coupled to the feed through device, wherein the first fiber optic line portion comprises a first Fiber Bragg Grating ("FBG").

2. The system of claim 1, wherein the second fiber optic line portion comprises a second FBG.

3. The system of claim 2, wherein the third fiber optic line portion comprises a third FBG.

4. The system of claim 1, wherein the third fiber optic line portion comprises a third FBG.

5. The system of claim 1, wherein the first FBG extends into at least one of the second fiber optic line portion and the third fiber optic line portion.

6. The system of claim 1, wherein at least one of the first FBG, the second FBG and the third FBG is operable to measure strain on at least one of the first fiber optic line portion, the second fiber optic line portion and the third fiber optic line portion.

7. The system of claim 1, wherein the first FBG is operable to measure temperature at a downhole location.

8. A pressure gauge device comprising:

an outer body having a pressure inlet;

a pressure sensor disposed within the outer body, wherein a first side of the pressure sensor is exposed to the pressure inlet;

a reference volume disposed within the outer body, wherein a second side of the pressure sensor is exposed to the reference volume;

a feedthrough device; and a fiber optic line, wherein the fiber optic line comprises a first portion disposed within the feedthrough device, a second portion disposed within the reference volume and a third portion disposed within a cable located outside of the pressure gauge device, and wherein the first portion of the fiber optic line comprises a first Fiber Bragg Grating ("FBG").

9. The pressure gauge device of claim 8, wherein the second fiber optic line portion comprises a second FBG.

10. The pressure gauge device of claim 9, wherein the third fiber optic line portion comprises a third FBG.

11. The pressure gauge device of claim 8, wherein the third fiber optic line portion comprises a third FBG.

12. The pressure gauge device of claim 8, wherein the first FBG extends into at least one of the second fiber optic line portion and the third fiber optic line portion.

13. The pressure gauge device of claim 8, wherein the first FBG is operable to measure temperature at a downhole location.

14. The pressure gauge device of claim 13, wherein at least one of the first FBG, the second FBG and the third FBG is operable to determine strain in at least one of the first portion, the second portion and the third portion of the fiber optic line.

15. A method of monitoring a pressure gauge device downhole comprising:

directing the pressure gauge device to a desired location downhole, wherein the pressure gauge device comprises a pressure sensor in an outer body, a reference volume disposed on a first side of the pressure sensor in the outer body and a pressure inlet disposed on a second side of the pressure sensor;

coupling a fiber optic line to the pressure sensor through a feedthrough device, wherein the fiber optic line comprises a first fiber optic line portion located within the feedthrough device, a second fiber optic line portion located within the reference volume and a third fiber optic line portion located within a cable located outside the pressure gauge device and coupled to the feed through device, disposing a first Fiber Bragg Grating ("FBG") on the first portion of the fiber optic line;

determining temperature at the desired location using the first FBG;

using the determined temperature at the desired location to determine strain on at least one of the first portion, the second portion and the third portion of the fiber optic line.

16. The method of claim 15, further comprising disposing a second FBG on the second fiber optic line portion.

17. The method of claim 16, further comprising using the first FBG and the second FBG in a differential mode.

18. The method of claim 16, further comprising disposing a third FBG on the third fiber optic line portion.

19. The method of claim 15, further comprising disposing a third FBG on the third fiber optic line portion.

20. The method of claim 15, further comprising extending the first FBG into at least one of the second fiber optic line portion and the third fiber optic line portion.

* * * * *